US005490678A

United States Patent [19]

Darnell

[11] Patent Number: 5,490,678

[45] Date of Patent: Feb. 13, 1996

[54] AMBIDEXTROUS BOOMERANG

[76] Inventor: Eric Darnell, 46 Douglas La., Norwich, Vt. 05055

[21] Appl. No.: 617,631

[22] Filed: Nov. 26, 1990

Related U.S. Application Data

[63] Continuation-in-part of Ser. No. 84,743, Aug. 13, 1987, Pat. No. Des. 312,480.

[51] Int. Cl.[6] ..... A63B 65/08

[52] U.S. Cl. ..... 273/426

[58] Field of Search ..... 273/426, 424; D21/82, 85, 86

[56] References Cited

U.S. PATENT DOCUMENTS

| | | | |
|---|---|---|---|
| 692,608 | 2/1902 | Beistow | 273/426 |
| 862,094 | 7/1907 | Morton | 273/426 |
| 3,565,434 | 2/1971 | Liston | 273/426 |
| 3,710,505 | 1/1973 | Linenfelser | 273/424 |
| 4,222,573 | 9/1980 | Adler | 273/426 |
| 4,284,278 | 8/1981 | Bradford | 273/426 |
| 4,421,320 | 12/1983 | Robson | 273/426 X |
| 4,479,655 | 10/1984 | Adler | 273/426 X |
| 4,591,164 | 5/1986 | Blight | 273/426 X |
| 4,772,030 | 9/1988 | Hunt | 273/426 |
| 4,817,961 | 4/1989 | Stone | 273/426 |
| 4,934,713 | 6/1990 | Hunter | 273/426 X |

*Primary Examiner*—Paul E. Shapiro

[57] ABSTRACT

Boomerang throwable by left-handed or right-handed persons to return to the thrower is homogeneous and includes plurality of arms extending radially from a central portion with each of the arms having leading and trailing edges symmetrical about respective radial axes of the arms.

4 Claims, 5 Drawing Sheets

AMBIDEXTROUS BOOMERANG

CROSS REFERENCE TO RELATED APPLICATION

This application is a continuation-in-part of application No. 07/084,743 filed Aug. 13, 1987, U.S. Pat. No. D 312,480.

BACKGROUND

The invention relates to boomerangs. Boomerangs are devices which are capable of being launched into the air, (usually being thrownby a person), flying in a continuous path, and returning to their point of origin.

Boomerangs began as hunting weapons and as sporting devices. Original boomerangs were most probably composed of wood, this being the only substance available to the original hunter-gatherers that was light enough to remain airborne, yet strong enough to act as an airfoil in boomerang construction.

More recently boomerangs have been used for entertainment and sport as well as hunting. With this change in purpose and the change in materials available, boomerangs are now composed of other materials besides wood. The prior art discloses several boomerangs constructed of modern materials such as metal, plastic or some combination of these materials.

Despite new materials being available for boomerang construction, several problems inherent in the design and construction of boomerangs remain unanswered.

First among these unanswered problems in the art of boomerang construction is the fact that conventional boomerangs are not able to be thrown with both the left and the right hand. Boomerangs have heretofore been designed to be used by persons throwing the boomerang with their right or their left hand, but not either hand at the user's discretion.

The invention answers this need in the present art of boomerang manufacture. By utilizing an air foil design unique to the invention, the invention is able to be used with either the left or the right hand. The user is not restricted in his choice of which hand will be used to launch the boomerang. A single embodiment of the invention can be thrown by any member of a group composed of both left and right handed persons. This allows greater utility for the boomerang. More players may use the same device in a game involving the boomerang, and no consideration of which hand a player has more facility with needs to be addressed.

Moreover, a special model fabricated solely for left handed users does not need to be manufactured. This eliminates unneeded production delays to produce a left handed model, thereby making the invention more efficient, in terms of time and money, to produce than conventional prior art boomerangs.

A further problem addressed by the invention deals with alteration of the flight characteristics of boomerangs. By adjusting the angle of the airfoils in a boomerang, the device will exhibit new and different flight characteristics. This process is known in the art as "tuning."

Early prior art boomerangs were composed of material, generally wood or metal, too rigid to allow any deformation of the boomerang's airfoils. Tuning of the boomerang for a specific flight pattern was performed during the boomerang's construction, and no tuning could be administered after their construction. Use of a softer, more pliable material allows deformation of the boomerang for tuning, but such materials also have drawbacks. Such softer materials do not have the rigidity required to act as an airfoil, or do not maintain the deformation long enough to allow the boomerang to exhibit the new flight characteristics for an appreciable period of time.

More recent prior art devices use a composite plurality of materials, generally metal sheets or wires embedded in a soft outer layer, to make an article which is both flexible to allow tuning and rigid enough to give some permanence to the tuning operations performed upon the boomerang. This composite or multiplicity of materials being used in the boomerang's manufacture results in a longer and more costly production process.

The invention utilizes its unique airfoil design to allow it to undergo the successive tunings while still being a single homogenous material. The invention is able to be administered repeated permanent, yet reformable, deformations to accomplish repeated tunings. The boomerang's unique airfoil structure gives the boomerang a memory capability while still being composed of a single, homogenous material. Being composed of a single, homogenous material, the invention is more economical and faster to produce, a further advantage over the boomerang disclosed by the prior art.

By being able to undergo repeated tuning processes, the boomerang of the invention is able to exhibit a multitude of flight patterns and remains unique to the user. The invention is able to be changed, giving the user the ability to experiment with the various and different flight characteristics capable with the invention.

SUMMARY OF THE INVENTION

The invention in one of its aspects provides a boomerang throwable by left or right handed persons to return to the thrower comprising a center portion from which identical arms extend radially, each of said arms having leading and trailing edges symmetrical about their respective radial axes. Each of these arms has a raised portion along the radial axis of said arm. All of these raised portions are on a common side of said boomerang and extending inwardly and joining one with another at the center portion of the boomerang. The boomerang in this aspect of the invention is constructed of a single, homogeneous material and is essentially planar. The arms have generally bulbous tips. Both the width and the cross sectional area of each the arms, transverse to the radial axis, proceeding outwardly from said center portion of said boomerang first lessen, then increase to a maximum point near the terminal end of each arm. Therefore, the center of mass of each of the arms is located more proximate the terminal end of the arm than the center portion. The boomerang of this aspect may contain holes which extend through the tips of each of the arms about the center of the arc which defines the tips of the arms.

DESCRIPTION OF THE PREFERRED EMBODIMENTS AND BEST NODE KNOWN FOR PRACTICE OF THE INVENTION

Figure 1:
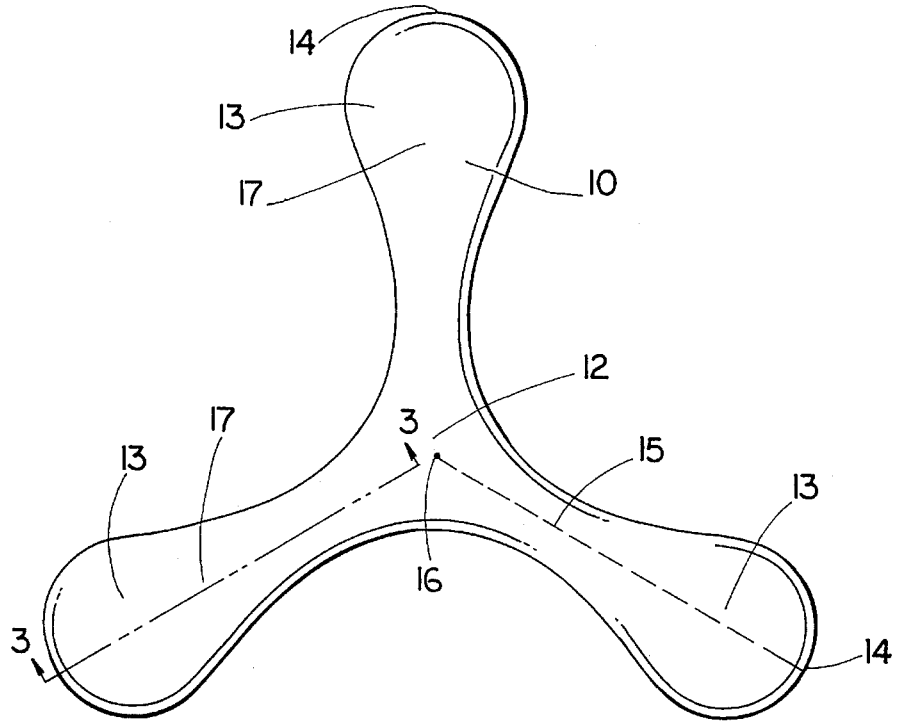
FIG. 1 is a view of the top side of one preferred embodiment of the invention.
Figure 2:
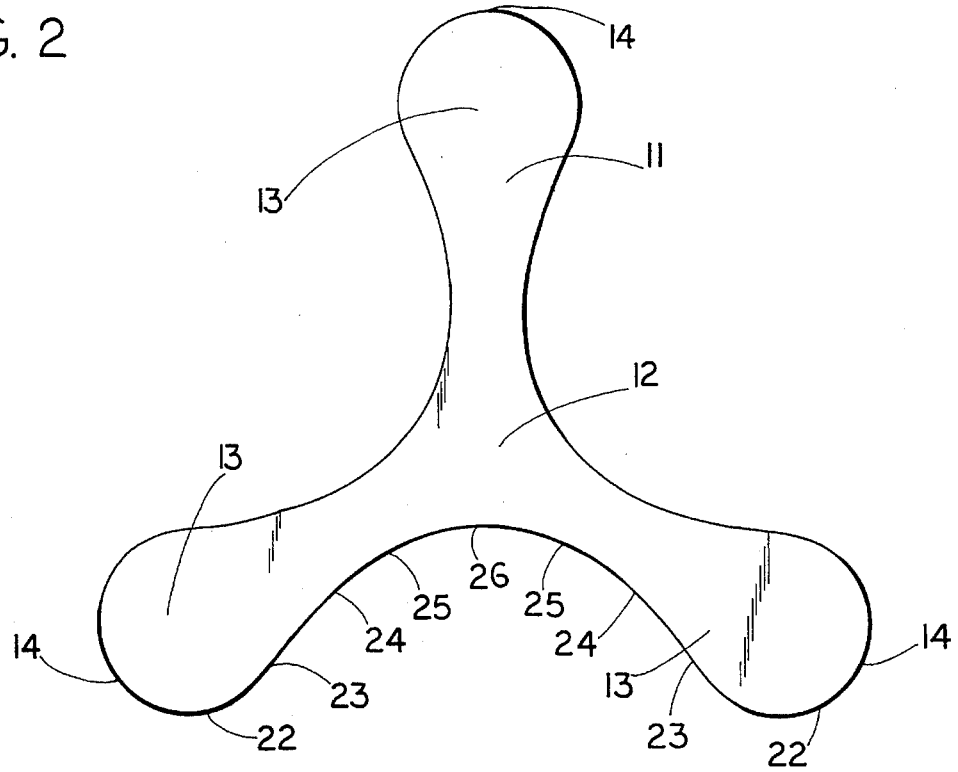
FIG. 2 is a view of the opposite side of the boomerang shown in FIG. 1.

Referring to the figures, one preferred embodiment of the invention is shown in FIGS. 1 and 2. The boomerang is generally planar and has two sides, a top side 10 shown in FIG. 1 and a bottom side 11 shown in FIG. 2. The boomerang is composed of a center portion 12 and three arms 13. The arms 13 extend from the center portion 12 to each arm's terminal end 14. The arms 13 extend along a radial axis 15, an imaginary line emanating from the center point 16 of the center portion 12 and passing through the center of each arm 13. Each of the three arms 13 is identical to all other arms 13 in the boomerang.

The bottom side 11 of the invention in this preferred embodiment is generally flat as shown by the absence of contour shading in FIG. 2.

Figure 3:
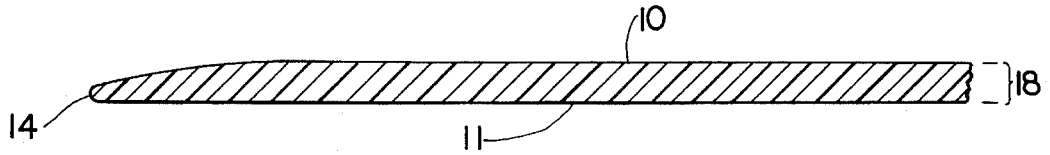
FIG. 3 is a cross sectional view of the arm of the boomerang shown in FIGS. 1 and 2, taken along line III—III.

Each arm 13 in the preferred embodiment of the invention has a raised portion 17 extending from the center portion 12 along the top side 10 parallel to the radial axis 15 of the arm 13. Said raised portions 17 join with each other at the center portion 12 and are all on the top side 10 of the boomerang. As can be seen in FIG. 3, the height of the boomerang 18, measured in the direction perpendicular to the plane of the boomerang, decreases along the length of the arm 13 in the direction away from the center portion 12.

Figure 4:
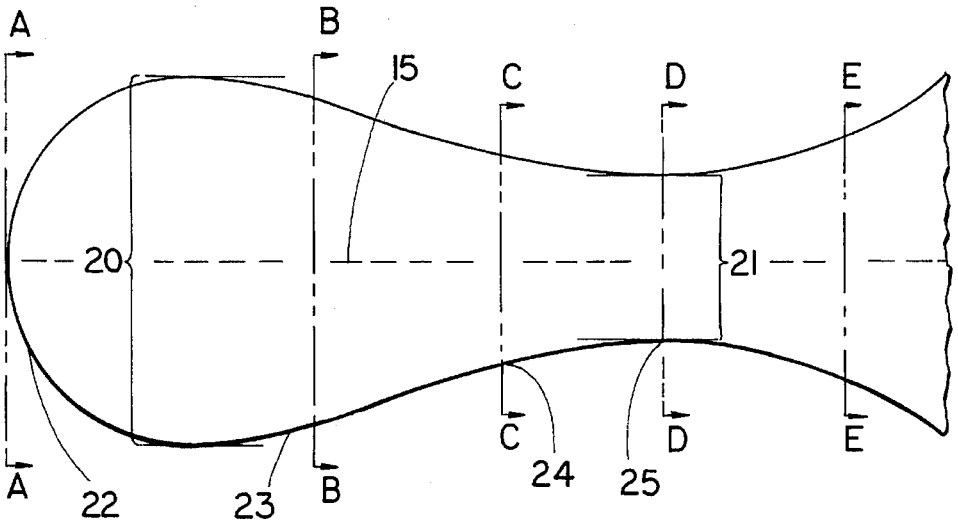
FIG. 4 is a view of an arm of the boomerang of the invention shown in FIGS. 1, 2 and 3.

FIG. 4 gives a detailed view of the arm 13 of this preferred embodiment of the invention. FIGS. 4A–E give various cross-sectional views of the arm 13 taken at various points along the radial axis 15 of the boomerang. With these views one can determine the contour of the unique airfoil design of the invention in this first preferred embodiment.

FIGS. 4A–E all disclose that the bottom side 11 of the invention in this preferred embodiment is generally flat along the arms 13 and the center portion 12. Further inspection of these figures reveals the top side 10 of the invention. The top side 10 contains a raised portion 17. The height of the raised portion 17 is at a maximum directly above the radial axis 15 and decreases continuously from the center to the outer periphery 19 of the arm 13. In all drawings it is to be noted that the contour of the raised portion 17 is symmetrical about the radial axis 15 all along the arm 13 of the boomerang. These Figures further illustrate the decrease in height of the boomerang 18 from the center portion 12 towards the terminal end 14 of the boomerang arms 13.

Figure 4A:
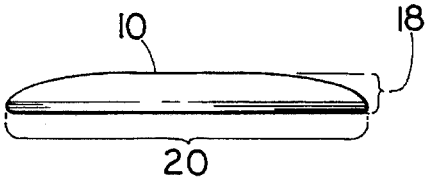
FIGS. 4A, 4B, 4C, 4D, and 4E are cross-sectional views taken along lines A—A, B—B, C—C, D—D, and E—E, respectively.
Figure 4B:
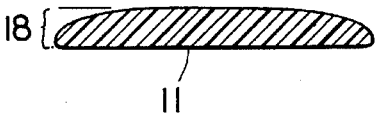
Figure 4C:
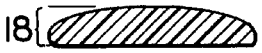
Figure 4D:
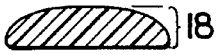
Figure 4E:
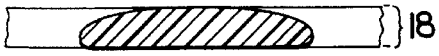

FIGS. 4A–E also illustrate the changes in the width and cross-sectional area of the arm 13 of the boomerang measured transversely to the radial axis 15 along the radial axis 15. FIG. 4A shows the arm 13 viewed looking from the terminal end 14 towards the center portion 12. From this view, the point of maximum width and maximum cross-sectional area 20 is viewed. FIG. 4B shows the cross-sectional view taken from a point just past the point of maximum width and maximum cross-sectional area 20 of the am 13. Further reduction of the width and cross-sectional area is revealed in FIG. 4C. FIG. 4D, taken at the point of minimum width also reveals the point of minimum cross-sectional area of the am 21. At FIG. 4E the cross-sectional area begins to increase at the center portion 12. The arms 13 are, therefore, generally bulbous in shape.

The boomerang of this embodiment of the invention is a single uniform homogenous material, preferably a foamed plastic. The material is homogenous, and therefore of uniform density. Hence the change in arm width and cross-sectional area revealed in FIGS. 4A–E correspond to the change in the mass of these localized portions of the boomerang. As the cross-sectional area is greater at the terminal end 14 of the arm 13 than at a position nearer the center portion 12, more of the boomerang's mass is located towards the terminal end 14 of the arm 13 than near the center portion 12.

In this preferred embodiment of the invention, the terminal ends 14 of the arms 13 are defined by arcs in the form of a semi-circle 22. These semi-circular tips progress into convex curves 23 on either side of the am 13 defining the periphery of the boomerang's arm approaching the center portion 12. These convex curves proceed continuously into a reverse curve 24 which is concave about the arms 13 at their point of minimum width 21. These reverse curves 24 join one to another to form a concave continuous curve which defines the periphery of the center portion 26. This periphery is concave about the center portion and is in the form of a semi-circle.

Figure 5:
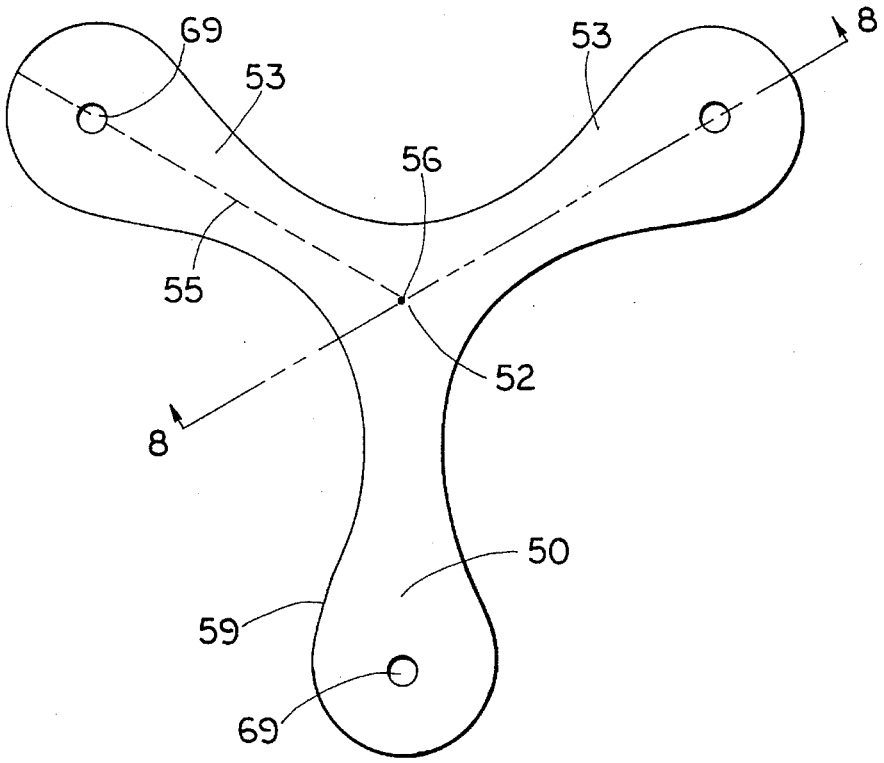
FIG. 5 is a view of the top side of the second embodiment of the invention.
Figure 6:
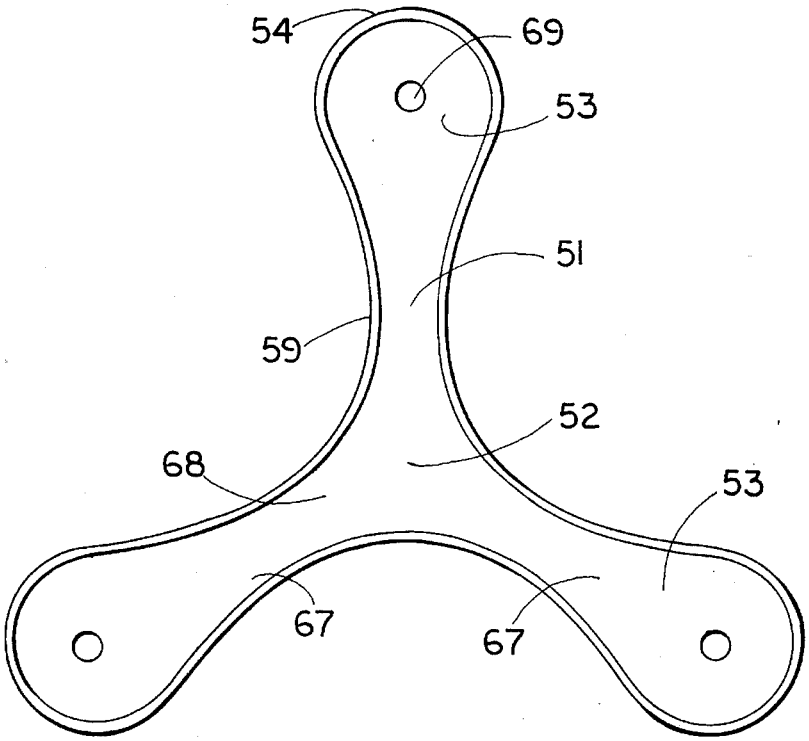
FIG. 6 is a view of the opposite side of the boomerang shown in FIG. 5.

A second preferred embodiment of the invention is shown in FIGS. 5 and 6. The boomerang is generally planar and has two sides, a top side 51 shown in FIG. 5 and a bottom side 51 shown in FIG. 6. The boomerang is composed of a center portion 52 and three arms 53. The arms 53 extend from the center portion 52 to each arm's terminal end 54. The arms 53 extend along a radial axis 55, an imaginary line emanating from the center point 56 of the center portion 52 and passing through the center of each arm 53. Each of the three arms 53 is identical to all other arms 53 in the boomerang.

The bottom side 51 of the invention in this preferred embodiment may have a concave portion 67 extending along each of the arms 53 parallel to the radial axis 55 of the arm 53. Said concave portions may join one with another at the center portion 52. The center portion in this preferred embodiment therefore has a concave portión 68 in the plane of the boomerang.

Figure 8:
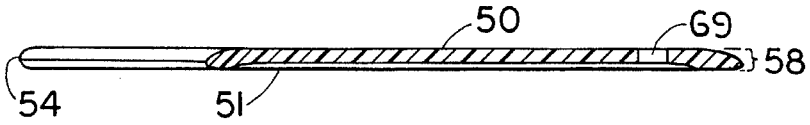
FIG. 8 is a cross sectional view of the boomerang taken along Line VII—VII.

Each arm 53 in the second preferred embodiment of the invention has a raised portion 57 extending from the center portion 52 along the top side 50 parallel to the radial axis 57 of the arm 53. Said raised portions 57 join with each other at the center portion 52 and are all on the top side 50 of the boomerang. As can be seen in FIG. 8, the height of the boomerang 58, measured in the direction perpendicular to the plane of the boomerang, is uniform along the length of the arm 53 in the direction away from the center portion 52 until decreasing at the terminal end 54 of the arm 53 where the top side 50 joins with the bottom side 51.

Figure 7:
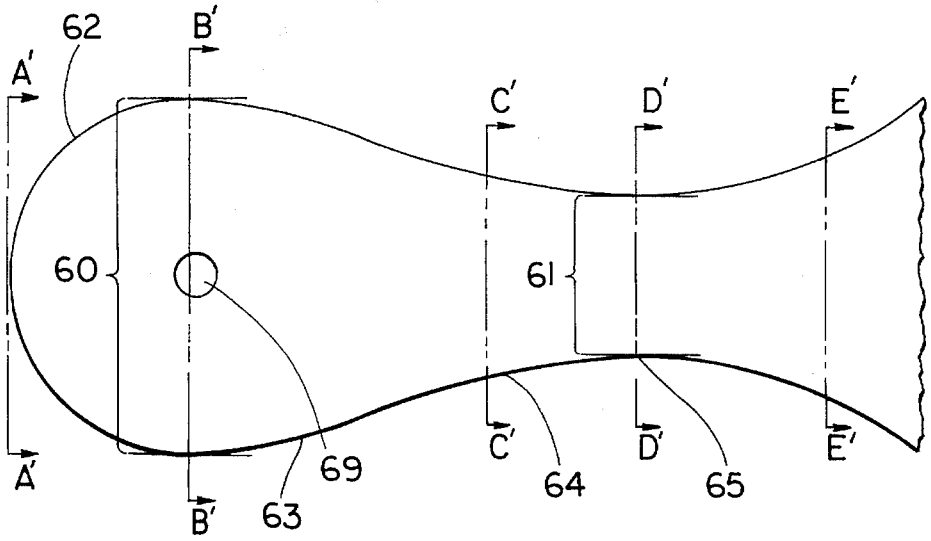
FIG. 7 is a view of the arm of the boomerang of the second preferred embodiment of the invention.

FIG. 7 gives a detailed view of the arm 53 of this preferred embodiment of the invention. FIGS. 7A-E give various cross-sectional views of the arm 53 taken at various points along the radial axis 55 of the boomerang. With these views one can determine the contour of the unique airfoil design of the invention in this second preferred embodiment.

FIGS. 7A–E all disclose that the bottom side 51 of the invention in this preferred embodiment is generally concave along the arms 53 and the center portion 52. The top side 50 contains a raised, preferably generally convex portion 57. The height of the raised portion 57 is at a maximum directly above the radial axis 55 and decreases continuously from the center to the outer periphery 59 of the arm 53. In all drawings it is to be noted that the contours of the raised surface on the top side 50 and the concave portion on the bottom side 51 are symmetrical about the radial axis 55 all along the arm 53 of the boomerang.

Figure 7A:
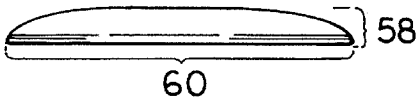
FIG. 7A–E are cross sectional views taken along line 'A'—'A' 'B'—'B' 'C'—'C' 'D'—'D' 'E'—'E' respectively.
Figure 7B:
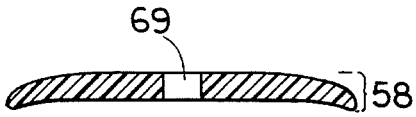
Figure 7C:
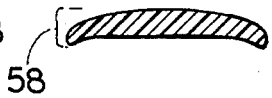
Figure 7D:
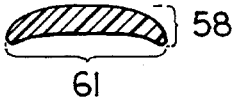
Figure 7E:
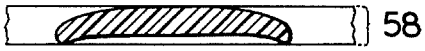

FIGS. 7A–E also illustrate the changes in the width and cross-sectional area of the arm 53 of the boomerang measured transversely to the radial axis 55 along the radial axis 55. FIG. 7A shows the arm 53 viewed looking from the terminal end 54 towards the center portion 52. From this view, the point of maximum width and maximum cross-sectional area 60 is viewed. FIG. 7B shows the cross-sectional view taken from a point just past the point of maximum width and maximum cross-sectional area 60 of the arm 53. Further reduction of the width and cross-sectional area is revealed in FIG. 7C. FIG. 7D, taken at the point of minimum width, also reveals the point of minimum cross-sectional area of the arm 61. At FIG. 7E the cross-sectional area begins to increase at the center portion 52. The arms 53 are, therefore, generally bulbous in shape.

The boomerang of this embodiment of the invention is comprised of a single uniform homogenous material, namely molded thermoplastic. The material is homogenous, and therefore of uniform density. Hence the change in arm width and cross-sectional area revealed in FIGS. 7A–E correspond to the change in the mass of these localized portions of the boomerang. As the cross-sectional area is greater than the terminal end 54 of the arm 53 than at a position nearer the center portion 52, more of the boomerang's mass is located towards the terminal end 54 of the arm 53 than near the center portion 52.

In this preferred embodiment of the invention, the terminal ends 54 of the arms 53 are defined by arcs in the form of a semi-circle 62. These semi-circular tips 62 progress into convex curves 63 on either side of the arm 53 defining the periphery of the boomerang's arm approaching the center portion 52. These convex curves proceed continuously into a reverse curve 64 which is concave about the arms 53 at their point of minimum width 61. These reverse curves 64 join one to another to form a concave continuous curve which defines the periphery of the center portion 66. This periphery is concave about the center portion 52 and is in the form of a semi-circle.

FIGS. 5 and 6 show a hole 69 through each of the anus 53 in this preferred embodiment of the invention. The hole 69 transcends through the arm, proximate the terminal end 54 of each of the anus 53. FIG. 7B is a cross sectional view of the arm 53 taken from line B'—B' which passes through the diameter of the hole 69. FIG. 7B shows the hole 69 passing through the arm 53 perpendicular to the plane of the boomerang about the center of the arc which the semi-circular tips 62. Similar holes may also be provided in the first past preferred embodiment, as described above.

Figure 9:
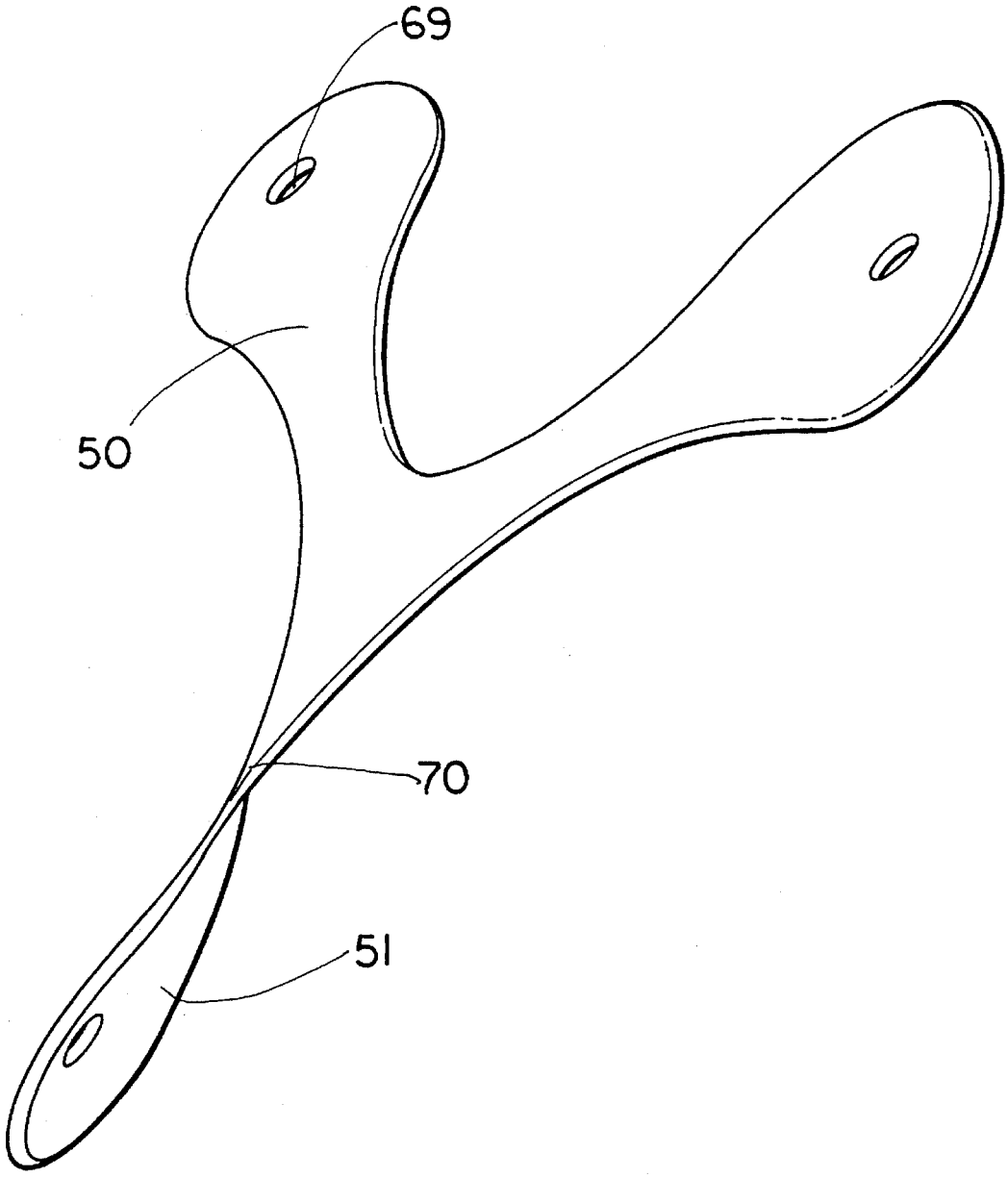
FIG. 9 is a view of the second preferred embodiment after tuning about the radial axis.

FIG. 9 details the boomerang of this second preferred embodiment of the invention wherein one of the anus 53 has been administered a rotation about the radial axis 55. Such rotation about the radial axis 55 produces a permanent, but re-deformable deformation 70 in the plane of the arm 53.

Such deformation 70 changes the flight characteristics of the boomerang, a process known as "tuning." The structure of the invention in this preferred embodiment allows this deformation 70 to be maintained by the boomerang of the invention without returning to its original shape unless desired by the boomerang thrower. This is accomplished in the invention without resort to constructing the invention from a composite or multiplicity of materials or elements.

The deformation 70 while permanent is changeable by the thrower. Should the thrower desire to return the boomerang to its original shape, or any other desired shape, he need simply redeform the arms 53 to the then desired configuration. This new deformation will remain in the boomerang until a still further deformation by the thrower.

It is to be understood that the twisting and memory characteristics of the boomerang are common to both embodiments of the boomerang. It is further to be understood that the preferred material for fabrication of the first embodiment of the boomerang according to the invention is cross-linked closed cell polyethylene foam. One suitable cross-linked closed cell polyethylene foam is sold under the trademark Plastazote by B. X. L. Plastics, Limited located in Croydon, Surrey, United Kingdom. Another suitable cross-linked closed cell polyethylene foam is sold under the trademark Volara by the Voltek Division of Sekisui America Corporation located in Lawrence, Mass.

It is further to be understood that the second embodiment of the invention is preferably made of polystyrene foam, which is substantially more rigid and has higher impact strength than the cross-linked closed cell polyethylene foam of which the first embodiment is preferably fabricated.

The first embodiment of the invention, when made of the crosslinked closed cell polyethylene foam may be thrown indoors with little if any risk inflicting personal injury to persons in the proximity and with no risk of damage to any furnishings in the structure. The invention according to the second embodiment is preferably restricted to outdoor use due to the higher impact strength of the polystyrene foam.

I claim:

1. A homogeneous, one-piece boomerang for outdoor use, throwable by left or right handed persons to return to the thrower comprising:

a. a homogeneous solid, imperforate center portion;

b. two sides, each opposing the other, said sides joining one to the other defining the periphery of said boomerang, said periphery being essentially planar;

c. three arms radiating symmetrically from said center portion, said arms having symmetric leading and trailing edges about their radial axes, each of said arms being like one another;

d. said arms having cross sectional areas transverse to their radial axes first decreasing then increasing outwardly along the radial axes of said arms, grater mass being at the extremity than proximate to said center portion, said arms having tips being generally bulbous;

e. said arms having a raised portion running inwardly along the radial axis of each of said arms towards said center portion, joining at said center portion one raised portion to another, said raised portions all being on a common side;

f. wherein the side opposite said side which contains said raised portions is concave along the radial axis of each of said arms with said concavity running inwardly towards said center portion where said concavities join one to another to from a concave surface on said center portion on said side opposite said side which contains said raised portions;

g. wherein the height perpendicular to said planar periphery first decreases then increases along said radial axis allowing rotation and deformation of the arms to occur; and h. wherein said boomerang is made of thermoplastic;

i. wherein rotation about the radial axis of each of said arms produces a permanent but redeformable deformation of said arms in the plane of said boomerang;

j. wherein after said arm rotation about the arm radial axis the plane of each of said arms is skew with respect to the original plane of said boomerang, said permanent but redeformable deformation causing different flight characteristics from those exhibited by said boomerang prior to application of said permanent but redeformable deformation.

2. The boomerang of claim 1 wherein the side opposite said side containing said raised portions is undercut, said undercuts running inwardly along the radial axis of each of said arms joining at the central portion one to another; wherein:

a. said arm tips are semi-circular;

b. said arms taper, along a convex curve, in the plane of said boomerang, inwardly from said semi-circular tips to a position of minimum arm width, intermediate said arm tips and said boomerang center;

c. said arms expand, in the plane of said boomerang, inwardly from said position of minimum arm width, defining a reverse curve which is concave about said position of minimum width;

d. the periphery of said center portion is defined by concave curves joining said reverse curves which define the peripheries of two adjacent arms, periphery of said boomerang defining a continuous curve.

3. A one-piece boomerang throwable by left-handed or right-handed persons to return to the thrower comprising:

a. a solid, imperforate center portion;

b. two sides, each opposing the other, said sides joining one to the other defining the periphery of said boomerang, said periphery being essentially planar;

c. a plurality of arms extending radially from said center portion, each of said arms having leading and trailing edges symmetrical about their respective radial axes;

d. each of said arms being like another;

e. each of said arms having a raised portion along the radial axis of said arm;

f. said raised portions all being on a common side of said boomerang;

g. said raised portions extending inwardly along their respective arms to said center portion adjoining one with another at said center portion of the boomerang;

h. said boomerang being constructed of a homogeneous material;

i. said periphery of said boomerang being essentially planar;

wherein the side opposite said side which contains said raised portions is concave along the radial axis of each of said arms with said concavity running inwardly towards said center portion where said concavities join one to another to from a concave surface on said center portion on said side opposite said side which contains said raised portions, and said arms are axially apertured on said tips proximate a radial position of maximum radial cross-sectional area of the arms.

4. A one-piece, homogeneous boomerang suitable for indoor use, throwable by left or right handed persons to return to the thrower comprising:

a. a solid, imperforate center portion;

b. two sides, each opposing the other, said sides joining one to the other defining the periphery of said boomerang, said periphery being essentially planar;

c. three arms radiating symmetrically from said center portion, said arms having symmetric leading and trailing edges about their radial axes, each arm being like another;

d. said arms having cross-section al areas transverse to their radial axes first decreasing then increasing outwardly along the radial axes of said arms, greater mass being at the extremity than proximate said center portion, said arms having tips being generally bulbous;

e. said arms each having a raised portion running inwardly along the radial axis of each of said arms towards said center portion, joining at said center portion one raised portion to another, said raised portions being all on a common side;

f. said side opposite said side containing said raised portions being essentially planar;

g. the height perpendicular to said planar periphery decreasing outwardly along the axis of said arms;

h. said boomerang being made of polyethylene foam;

wherein the side opposite said side which contains said raised portions is concave along the radial axis of each of said arms with said concavity running inwardly towards said center portion where said concavities join one to another to from a concave surface on said center portion on said side opposite said side which contains said raised portions, and said arms are axially apertured on said tips proximate a radial position of maximum radial cross-sectional area of the arms.

* * * * *